US010576744B2

(12) United States Patent
Zhang

(10) Patent No.: US 10,576,744 B2
(45) Date of Patent: Mar. 3, 2020

(54) LIQUID DISCHARGE HEAD AND CHANNEL STRUCTURE

(71) Applicant: SEIKO EPSON CORPORATION, Tokyo (JP)

(72) Inventor: Junhua Zhang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/191,285

(22) Filed: Nov. 14, 2018

(65) Prior Publication Data

US 2019/0143687 A1 May 16, 2019

(30) Foreign Application Priority Data

Nov. 16, 2017 (JP) ..... 2017-220605
Apr. 18, 2018 (JP) ..... 2018-079564

(51) Int. Cl.
*B41J 2/14* (2006.01)

(52) U.S. Cl.
CPC ..... *B41J 2/1433* (2013.01); *B41J 2/14233* (2013.01); *B41J 2002/14362* (2013.01); *B41J 2002/14419* (2013.01)

(58) Field of Classification Search
CPC ..... B41J 2/14233; B41J 2002/14419; B41J 2002/14362
USPC ..... 347/20, 45, 47
See application file for complete search history.

(56) References Cited

U.S. PATENT DOCUMENTS

| | | | | |
|---|---|---|---|---|
| 9,352,596 | B2 * | 5/2016 | Miyajima | B41J 11/04 |
| 9,937,710 | B2 * | 4/2018 | Zhang | B41J 2/0451 |
| 2002/0180849 | A1 | 12/2002 | Sakai et al. | |
| 2005/0041061 | A1 | 2/2005 | Ishizawa et al. | |

FOREIGN PATENT DOCUMENTS

| | | | |
|---|---|---|---|
| JP | 2003-34042 | A | 2/2003 |
| JP | 2004-142128 | A | 5/2004 |
| JP | 2004-325153 | A | 11/2004 |
| JP | 2015-163440 | A | 9/2015 |
| JP | 2017-007138 | A | 1/2017 |

* cited by examiner

*Primary Examiner* — An H Do
(74) *Attorney, Agent, or Firm* — Workman Nydegger

(57) ABSTRACT

A channel structure includes a channel is formed in a channel member and a plurality of openings that allow the channel to communicate with an outside. The plurality of openings are closed by respective lid members. At least one of the lid members that closes at least one of the plurality of openings has air permeability.

7 Claims, 12 Drawing Sheets

LIQUID DISCHARGE HEAD AND CHANNEL STRUCTURE

BACKGROUND

1. Technical Field

The present invention relates to a technique of discharging liquid such as ink.

2. Related Art

A liquid discharge head that discharges liquid such as ink from nozzles has plurality of channels. For example, JP-A-2015-163440 discloses a liquid discharge head formed by laminating channel members in which a plurality of channels are formed. Some channel members have openings that allow the channels inside the channel members to communicate with the outside. Examples of such openings include, for example, nozzles. Thus, when the liquid discharge head or the channel members are transported, the openings communicating with the outside may be closed by protective films so as to suppress entry of foreign matter into the channels during transportation.

Meanwhile, the component may be transported under an environment where the atmospheric pressure or temperature largely varies such as an environment during an airlift. In such a case, depending on the material of the protective films or the method of closing the openings communicating with the outside, simply closing the openings by the protective films may result in, due to variation in atmospheric pressure or temperature in the channels, deformation of the channels or, even when the channels are not deformed, fatigue of the channel members themselves. Such fatigue of the channel members may lead to degradation of strength.

SUMMARY

An advantage of some aspects of the invention is to, during transportation, suppress entry of foreign matter into channels and suppress deformation of the channels or fatigue of channel members due to variation in atmospheric pressure or temperature.

A channel structure according to a first aspect of the invention includes a channel member in which a channel is formed. The channel structure has a plurality of openings that allow the channel to communicate with an outside. The plurality of openings are closed by respective lid members. At least one of the lid members that closes at least one of the plurality of openings has air permeability. According to the above-described form, the plurality of openings that allow the channel to communicate with the outside are closed by the lid members. This can suppress entry of foreign matter such as dust or dirt into the channel during transportation. Furthermore, the at least one of the lid members that closes the at least one of the plurality of openings has the air permeability. Thus, during transportation, even when air in the channel or the openings expands or contracts due to variation in atmospheric pressure or pressure, the air in the channel can pass through the lid members. This can suppress deformation of the channel or reduction in strength due to fatigue of the channel member. Accordingly, with this form, during transportation, entry of foreign matter into the channel can be suppressed and deformation of the channels or fatigue of the channel members due to variation in atmospheric pressure or temperature can be suppressed.

It is preferable that all of the plurality of openings be closed by lid members having the air permeability. According to this form, all of the plurality of openings are closed by the lid members having the air permeability. Thus, the air in the channel or the openings easily passes through the lid members. This can reduce stress applied to the channel member due to the expansion or contraction of the air in the channel or the openings.

It is preferable that a diameter of at least one air hole of the at least one of the lid members having the air permeability be 1/100 to 1/10 of a minimum width of a section of the channel. According to this form, the diameter of the at least one air hole of the at least one of the lid members having the air permeability is 1/100 to 1/10 of the minimum width of the section of the channel. Thus, even when the openings are closed by the lid members, the air easily passes while foreign matter is unlikely to enter.

It is preferable that the at least one air hole include a plurality of air holes, and an average diameter of the plurality of air holes of the at least one of the lid members having the air permeability be 10 nm to 100 μm. According to the above-described form, the average diameter of the plurality of air holes of the at least one of the lid members having the air permeability is 10 nm to 100 μm. Thus, the lid member allows the air in the channel to pass therethrough and entry of small foreign matter into the channel can be suppressed.

It is preferable that the at least one of the lid members having the air permeability have a Gurley value of 0.5 to 2000 s/100 mL. According to the above-described form, the at least one of the lid members having the air permeability has a Gurley value of 0.5 to 2000 s/100 mL. Thus, the air easily passes through the lid member when the atmospheric pressure varies. This can effectively suppress deformation of the channel or reduction in strength due to fatigue of the channel members.

It is preferable that the channel structure have a nozzle that communicates with the channel, and the plurality of openings include an opening of the nozzle. According to the above-described form, the channel structure has a nozzle that communicates with the channel, and the plurality of openings include an opening of the nozzle. Thus, even when a liquid discharge head or the channel member in which the nozzle is formed is transported as a single unit, during transportation, entry of foreign matter into the channel can be suppressed and deformation of the channel or fatigue of the channel member due to variation in atmospheric pressure or temperature can be suppressed.

In order to address the above-described problem, a liquid discharge head according to a second aspect of the invention includes a channel member in which a channel is formed. The liquid discharge head has a plurality of openings that allow the channel to communicate with an outside. The plurality of openings include an opening of a nozzle and an opening that is other than the opening of the nozzle. The plurality of openings are closed by respective lid members. At least one of the lid members that closes at least one of the plurality of openings has air permeability. According to this form, even when the liquid discharge head is transported as a single unit, during transportation, entry of foreign matter into the channel can be suppressed and deformation of the channel or fatigue of the channel member due to variation in atmospheric pressure or temperature can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
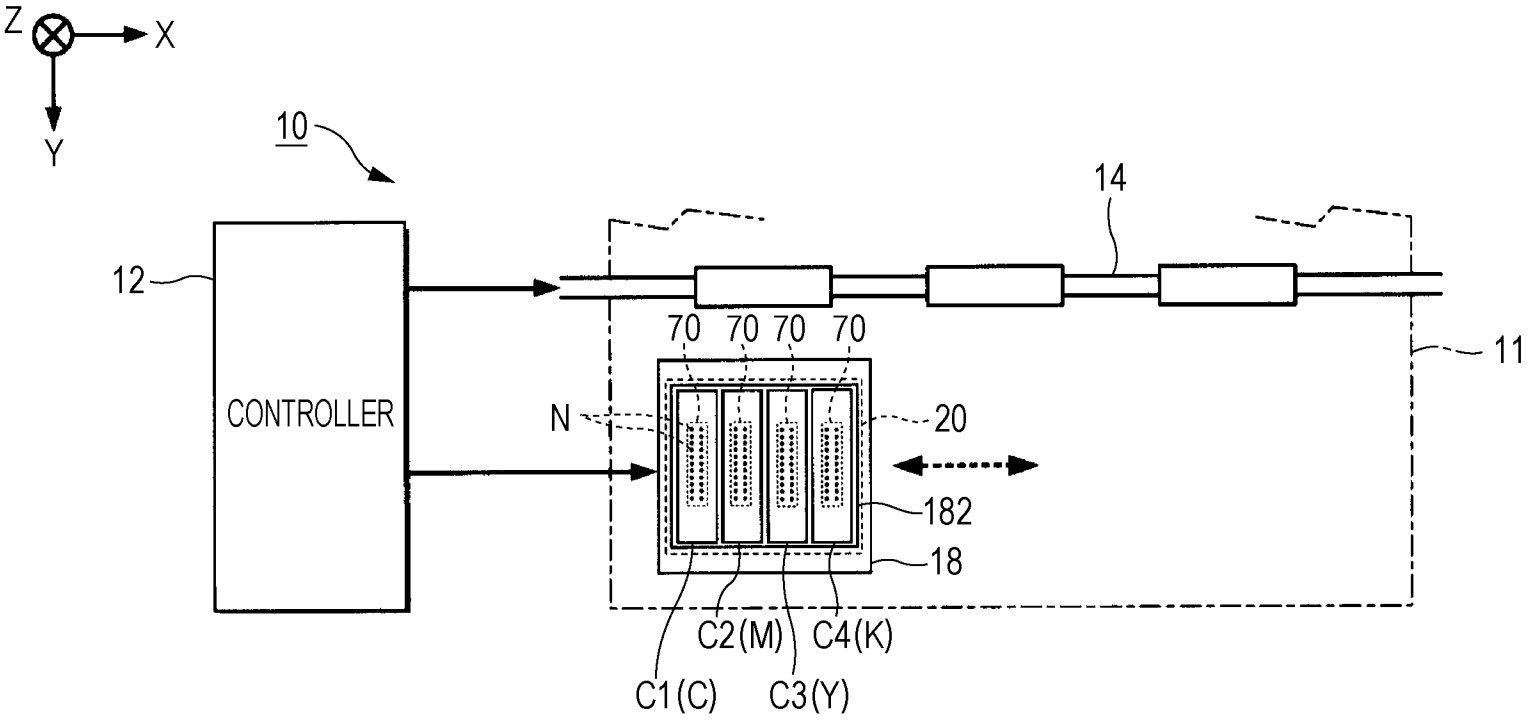
FIG. 1 illustrates a structure of a liquid discharge apparatus according to a first embodiment.

FIG. 1 illustrates a structure of part of a liquid discharge apparatus 10 according to a first embodiment of the invention. The liquid discharge apparatus 10 according to the first embodiment is an ink jet printer in which ink that exemplifies liquid is discharged to a medium 11 such as a sheet of printing paper. The liquid discharge apparatus 10 illustrated in FIG. 1 includes a controller 12, a transport mechanism 14, a carriage 18, and a liquid discharge head 20. The controller 12 performs centralized control on the elements of the liquid discharge apparatus 10.

The transport mechanism 14 transports the medium 11 in the Y direction (sub-scanning direction) under the control of the controller 12. The carriage 18 reciprocates in the X direction (main scanning direction) under the control of the controller 12. Along with the transportation of the medium 11 and the reciprocation of the carriage 18, the liquid discharge head 20 discharges the ink to the medium 11. Thus, a desired image is formed on the surface of the medium 11. Hereafter, a direction perpendicular to the X-Y plane (plane parallel to the surface of the medium 11) is referred to as the Z direction. A direction in which the ink is discharged by the liquid discharge head 20 (downward in the vertical direction) corresponds to the Z direction.

The carriage 18 is provided with a liquid containing unit 182 (cartridge holder) that contains a plurality of liquid containers C1 to C4 (cartridges) that separately store a plurality of types of ink, respectively. The ink is liquid containing colorants such as pigments or dyes and is the liquid (color ink) of four colors including, for example, cyan (C), magenta (M), yellow (Y), and black (K). A resin material can be contained in the ink. The liquid containers C1 to C4 according to the present embodiment respectively contain cyan (C) ink, magenta (M) ink, yellow ink (Y), and black (K) ink. The liquid discharge head 20 is mounted below the liquid containing unit 182 of the carriage 18. The structure and the number of the liquid containers C1 to C4 are not limited to those exemplified herein.

The liquid discharge head 20 includes a plurality of liquid discharge units 70 (head chips). Each of the liquid discharge units 70 is a channel structure which includes channel members in which channels are formed. According to the present embodiment, an example is illustrated in which four liquid discharge units 70 are arranged in the X direction. Each of the liquid discharge units 70 has two nozzle rows arranged therein. Each of the nozzle rows is a cluster of a plurality of nozzles N arranged along a straight line in the Y direction. The numbers and arrangement of the liquid discharge units 70 and the nozzle rows are not limited to those illustrated in the example. The liquid discharge head 20 has channels through which the ink flows and filters that filter the ink flowing through the channels.

Figure 2:
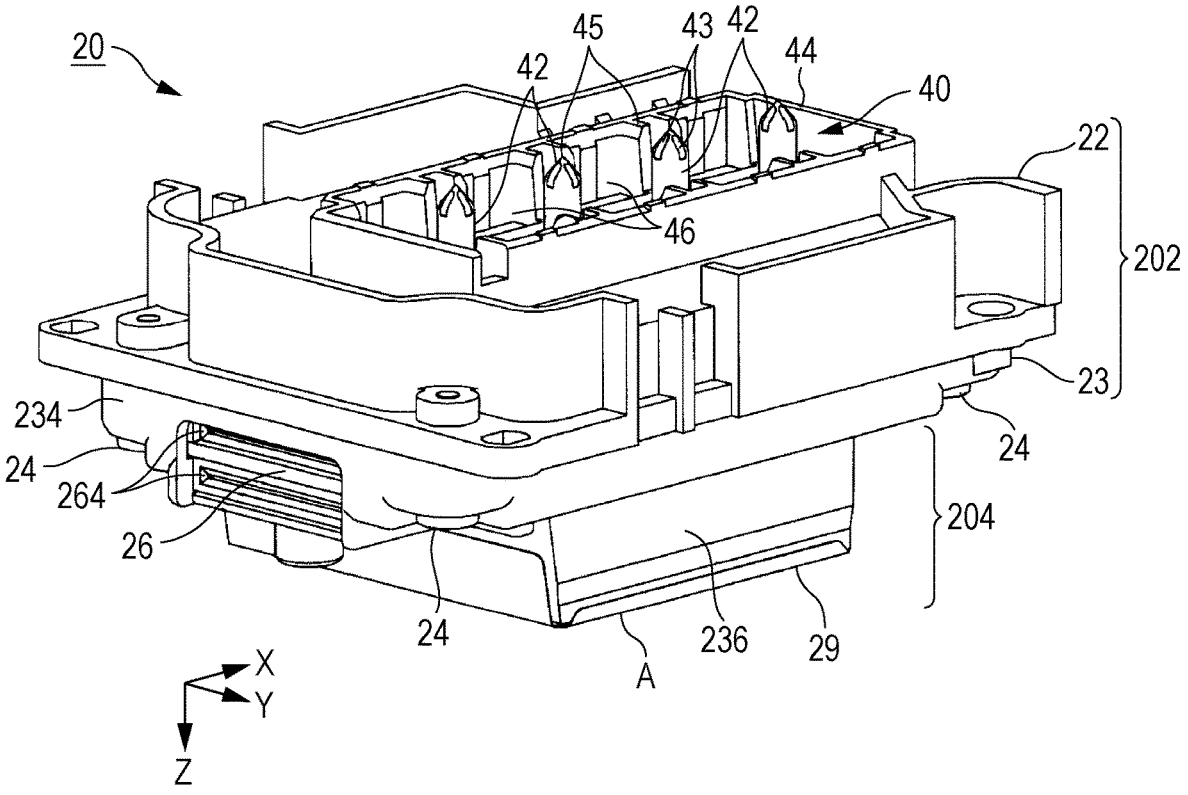
FIG. 2 is an external perspective view of a liquid discharge head.
Figure 3:
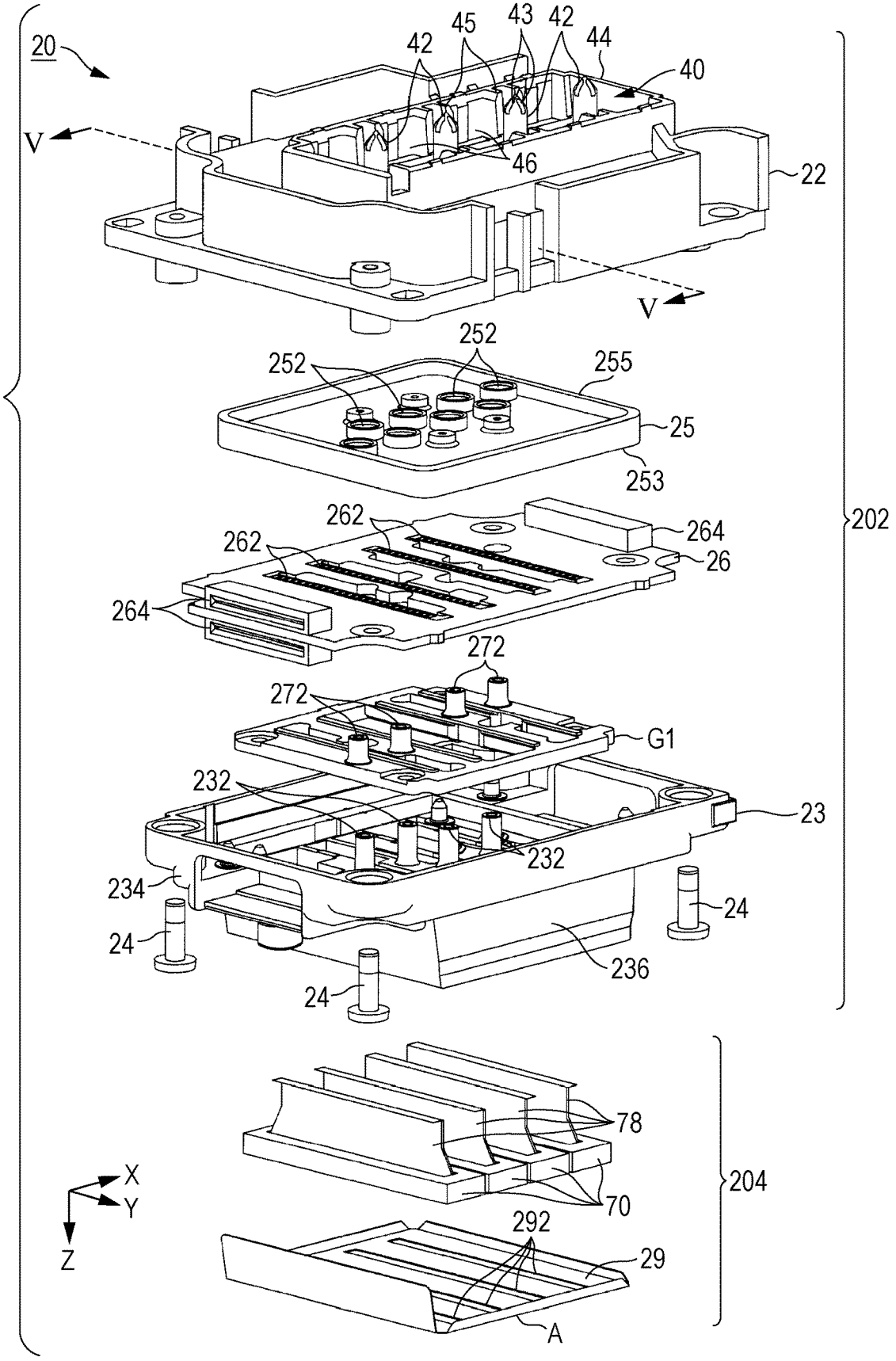
FIG. 3 is an exploded perspective view of the liquid discharge head.
Figure 4:
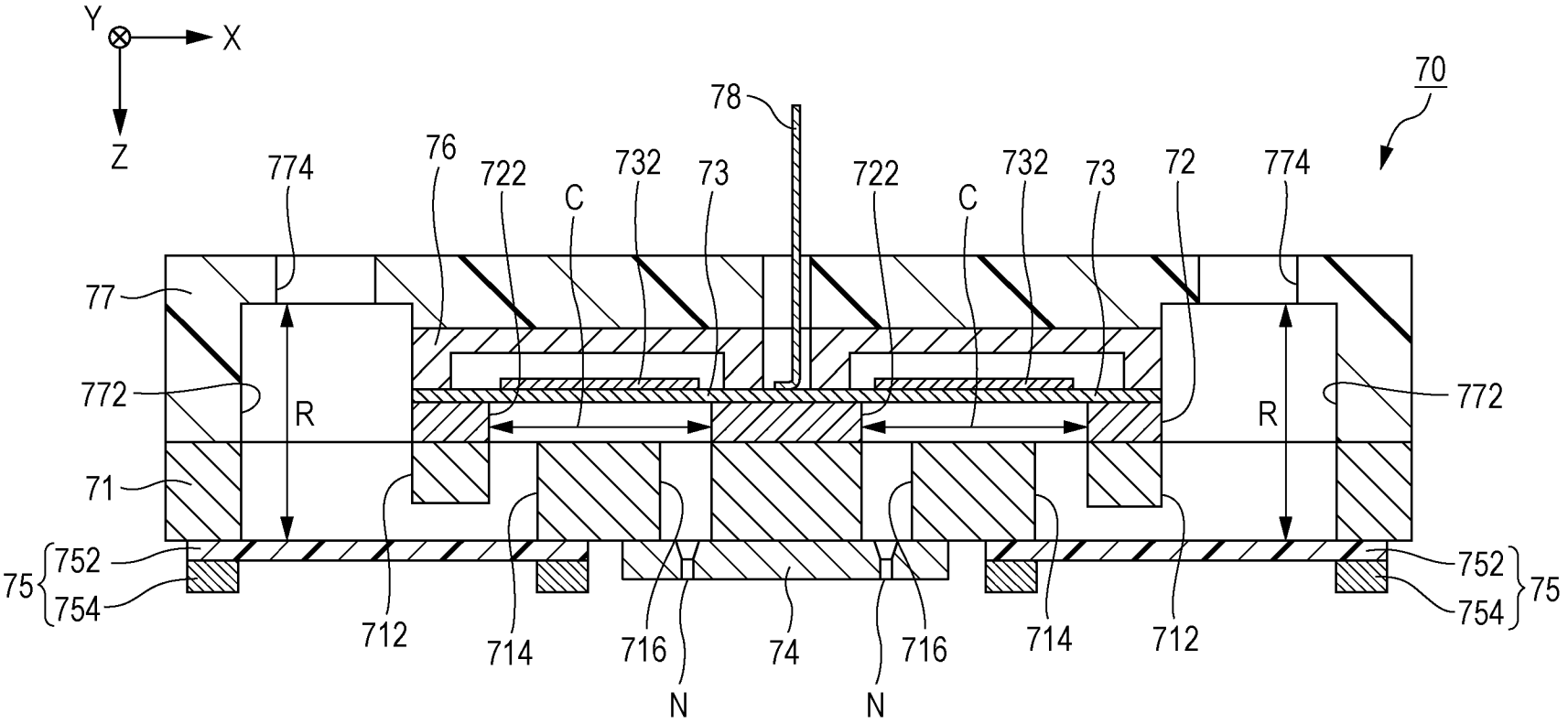
FIG. 4 is a sectional view of a liquid discharge unit.
Figure 5:
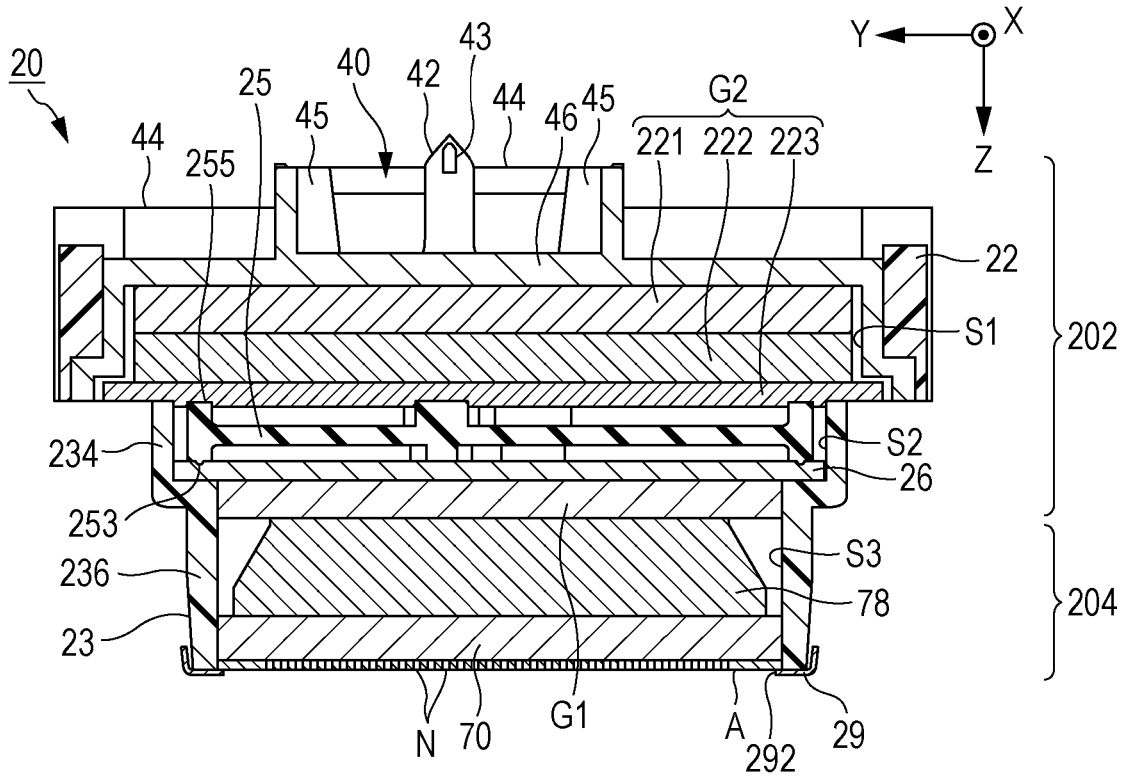
FIG. 5 is a sectional view of the liquid discharge head illustrated in FIG. 3 taken along line V-V.

FIG. 2 is an external perspective view of the liquid discharge head 20. FIG. 3 is an exploded perspective view of the liquid discharge head 20. FIG. 4 is a sectional view of arbitrary one of the liquid discharge units 70. FIG. 5 is a view of a section (section parallel to the Y-Z plane) of the liquid discharge head 20 illustrated in FIG. 3 taken along line V-V. As illustrated in FIGS. 2 and 3, the liquid discharge head 20 according to the present embodiment includes a channel unit 202 and a head main body 204. The four liquid discharge units 70 described above are arranged in the head main body 204. The channel unit 202 supplies the cyan (C) ink, the magenta (M) ink, the yellow ink (Y), and the black (K) ink from the liquid containers C1 to C4 to the respective liquid discharge units 70 of the head main body 204.

As illustrated in FIG. 4, the liquid discharge units 70 each contain a head chip in which a pressure chamber forming substrate 72 and vibrating plates 73 are laminated on one of the surfaces of a channel forming substrate 71 and a nozzle plate 74 and compliance portions 75 are provided on the other surface of the channel forming substrate 71. A plurality of the nozzles N are formed in the nozzle plate 74. Structures corresponding to one and the other rows of the nozzles N are substantially symmetric about a line in each of the liquid discharge units 70. Accordingly, for convenience, the following description focuses on a single row of the nozzles N to describe the structure of the liquid discharge unit 70.

The channel forming substrate 71 is a flat plate-shaped channel member defining channels for the ink. The channel forming substrate 71 according to the present embodiment has openings 712, supply channels 714, and communication channels 716. The supply channels 714 are each formed for a corresponding one of the nozzles N, and the communication channels 716 are each formed for a corresponding one of the nozzles N. The openings 712 continues along a plurality of the nozzles N. The pressure chamber forming substrate 72 is a flat plate-shaped channel member having a plurality of openings 722 corresponding to the different nozzles N. The channel forming substrate 71 and the pressure chamber forming substrate 72 are each formed of, for example, a single-crystal silicon substrate.

The compliance portions 75 illustrated in FIG. 4 are mechanisms that suppress (absorb) variation in pressure in the channels of the liquid discharge units 70 and include sealing plates 752 and support bodies 754. The sealing plates 752 are flexible film-shaped members. The support bodies 754 secure the sealing plates 752 to the channel forming substrate 71 so as to close the openings 712 and the supply channels 714 of the channel forming substrate 71.

The vibrating plates 73 are disposed on the surface of the pressure chamber forming substrate 72 on the opposite side to the channel forming substrate 71 illustrated in FIG. 4. Each of the vibrating plates 73 is a flat plate-shaped member that can elastically vibrate and formed by, for example, laminating an elastic film formed of an elastic material such as silicon oxide and an insulating film formed of an insulating material such as zirconium oxide one on top of another. The vibrating plates 73 and the channel forming substrate 71 face one another with gaps therebetween inside the openings 722 formed in the pressure chamber forming substrate 72. Spaces interposed between the channel forming substrate 71 and the vibrating plates 73 inside the openings 722 function as pressure chambers C (cavities) that apply pressure on the ink. According to the present embodiment, two rows of a plurality of the pressure chambers C, which are arranged in the Y direction, are arranged in the X direction.

A plurality of piezoelectric elements 732 corresponding to the different nozzles N are formed in the surface of the vibrating plates 73 on the opposite side to the pressure chamber forming substrate 72. Each of the piezoelectric elements 732 is a laminate in which electrodes face each other with a piezoelectric body interposed therebetween. When the piezoelectric elements 732 vibrate together with the vibrating plates 73 due to drive signals supplied thereto, the pressures in the pressure chambers C are varied, thereby the ink in the pressure chambers C is discharged from the nozzles N. Thus, the piezoelectric elements 732 function as drive elements that generate drive forces to discharge the ink from the nozzles N. The piezoelectric elements 732 are sealed and protected by protective plates 76 secured to the vibrating plates 73.

As illustrated in FIG. 4, the support body 77 is secured to the channel forming substrate 71 and the protective plates 76. The support body 77 has an integral structure formed of, for example, a resin material by molding. The support body 77 according to the present embodiment is a channel member having spaces 772 that form, together with the openings 712 of the channel forming substrate 71, liquid storage chambers R (reservoir). The support body 77 also has supply ports 774 communicating with the liquid storage chambers R. The liquid storage chambers R store the ink introduced from the supply ports 774. The ink stored in the liquid storage chambers R is distributed to and filled in the pressure chambers C through the plurality of supply channels 714 and discharged from the pressure chambers C to the outside (medium 11 side) through the communication channels 716 and the nozzles N.

End portions of individual wiring substrates 78 are coupled to the vibrating plates 73. The individual wiring substrates 78 are flexible wiring substrates in each of which wiring is formed. The drive signals and a power voltage are transmitted to the piezoelectric elements 732 through the wiring of the individual wiring substrates 78. Each of the four liquid discharge units 70 is provided with a corresponding one of the individual wiring substrates 78. The individual wiring substrates 78 are connected to a circuit substrate 26, which will be described later.

As illustrated in FIGS. 2 and 3, the channel unit 202 includes a case member that includes an upper case member 22 and a lower case member 23 and that contains elements therein. The upper case member 22 has an integral structure formed of, for example, a resin material by injection molding. The lower case member 23 has an integral structure formed of, for example, a resin material by injection molding. The upper case member 22 and the lower case member 23 are secured to each other by a plurality of screws 24.

As illustrated in FIGS. 3 and 5, a space S1 is formed on the lower side of the upper case member 22. A space S2 is formed on the upper side of the lower case member 23, and a space S3 is formed on the lower side of the lower case member 23. The space S1 of the upper case member 22 communicates with the space S2 of the lower case member 23.

A sealing member 25, the circuit substrate 26, and a first channel unit G1 are sequentially laminated in this order from the top in the space S2 of the lower case member 23. The plurality of liquid discharge units 70 are contained in the space S3 of the lower case member 23. The space S3 of the lower case member 23 is closed by a securing plate 29 at the bottom. A second channel unit G2 is contained in the space S1 of the upper case member 22.

The second channel unit G2 is a channel structure that includes a plurality of structural members 221, 222, 223 that are laminated. The structural members 221, 222, 223 are channel members in which channels of the ink (not illustrated) are formed. The filters having been described are provided partway along the channels in the structural member 222. The structural members 221, 222, 223 are omitted from FIG. 3.

The circuit substrate 26 relays the drive signals, other control signals, and so forth transmitted from the controller 12. The circuit substrate 26 has terminal portions 262 electrically connected to the individual wiring substrates 78 of the liquid discharge units 70. Also, connectors 264 for connection to the controller 12, other electronic components, and so forth are mounted on the circuit substrate 26. The terminal portions 262 and the connectors 264 are electrical coupling portions. Four terminal portions 262 corresponding to the individual wiring substrates 78 of four liquid discharge units 70 are formed on an upper surface (surface on the negative side in the Z direction) of the circuit substrate 26 according to the present embodiment. Furthermore, wiring members such as flexible flat cables (FFCs) are connected to the connectors 264. Thus, the circuit substrate 26 receives the drive signals from the controller 12 through the FFCs. The connectors 264 of the circuit substrate 26 according to the present embodiment are disposed in side walls 234 of the lower case member 23 on both the positive and negative sides in the X direction so as to be exposed in openings of the side walls 234.

The first channel unit G1 is a flat plate-shaped channel structure in which the channels for the ink are formed. The first channel unit G1 may be a laminate of a plurality of channel members. The lower case member 23 has a plurality of channels 232 projecting upward. The first channel unit G1 has a plurality of channels 272 projecting upward. The channels 232 pass through through holes formed in the first channel unit G1 and the circuit substrate 26 and communicate with channels of the structural members 221, 222, 223 through through holes 252 of the sealing member 25. The channels 272 pass through through holes formed in the circuit substrate 26 and communicate with channels of the structural members 221, 222, 223 through through holes 252 of the sealing member 25. The ink is introduced into the liquid discharge units 70 through the channels 232, 272.

A surrounding fence-shaped frame body 236 defines a space that contains the liquid discharge units 70. The frame body 236 projects downward (positive side in the Z direction) from a lower end of the lower case member 23. According to the present embodiment, four liquid discharge units 70 are arranged side-by-side in the frame body 236 in the X direction (main scanning direction) perpendicular to the transport direction of the medium 11. The piezoelectric elements 732 of the liquid discharge units 70 vibrate corresponding to the drive signals supplied from the controller 12 through the circuit substrate 26 and the individual wiring substrates 78. When the pressures in the pressure chambers C vary due to vibration of the piezoelectric elements 732, the ink filled in the pressure chambers C is discharged from the nozzles N of the nozzle plate 74.

The securing plate 29 has a flat plate shape. The securing plate 29 has four openings 292 having a shape corresponding to the nozzle plate 74 (rectangular shape elongated in the Y direction) of each of the liquid discharge units 70. Each of the openings 292 is provided for a corresponding one of the liquid discharge units 70. The liquid discharge units 70 are each secured to an upper surface (surface on the negative side in the Z direction) of the securing plate 29 by, for example, an adhesive such that the nozzle plate 74 is positioned inside the opening 292. In this way, nozzles N of the nozzle rows are disposed inside the openings 292. The liquid discharge head 20 is not necessarily provided with the securing plate 29.

A relay unit 40 that relays the ink from the liquid containers C1 to C4 to channels of the upper case member 22 is provided on an upper surface of the upper case member 22 (surface on the opposite side to a discharge surface A). The relay unit 40 includes ink introduction needles 42 (relay members) and surrounding walls 44. The ink introduction needles 42 stand erect on the upper surface of the upper case member 22. The surrounding walls 44 surround the ink introduction needles 42. According to the present embodiment, a total of four ink introduction needles 42 corresponding to the liquid containers C1 to C4 of the four colors are arranged in the X direction (main scanning direction) perpendicular to the transport direction of the medium 11.

The ink introduction needles 42 are hollow needle-shaped member inserted into the liquid containers C1 to C4. The ink introduction needles 42 have respective introduction holes 43 at the tips thereof. The introduction holes 43 communicate with the channels in the structural members 221, 222, 223. The introduction holes 43 allow the ink in the liquid containers C1 to C4 to be introduced therethrough to the respective liquid discharge units 70 from the channels 232 of the lower case member 23 and the channels 272 of the first channel unit G1 through the channels of the structural members 221, 222, 223.

The ribs 45 provided inside the surrounding walls 44 divide the relay unit 40 into a total of four cartridge regions 46 arranged in the X direction. Each of the ink introduction needles 42 stands erect in a corresponding one of the cartridge regions 46. Furthermore, the liquid containers C1 to C4 are respectively mounted in the cartridge regions 46.

The sealing member 25 illustrated in FIGS. 3 and 5 is a plate-shaped elastic member having a downstream annular sealing portion 253 and an upstream annular sealing portion 255 respectively disposed on the lower side (downstream side) and the upper side (upstream side) at circumferential edges of the sealing member 25. The thickness of the sealing member 25 is increased at the downstream annular sealing portion 253 and the upstream annular sealing portion 255. The sealing member 25 is disposed between a space in which the head main body 204, the circuit substrate 26, and the first channel unit G1 are disposed and a space in which the second channel unit G2 is disposed. Thus, the sealing member 25 airtightly seals these spaces.

The downstream annular sealing portion 253 is pressed against the circuit substrate 26, thereby the downstream annular sealing portion 253 is brought into tight contact with the circuit substrate 26 without being firmly secured by, for example, an adhesive. A surface (surface on the negative side in the Z direction) of the upstream annular sealing portion 255 in contact with the structural member 223 is pressed against the structural member 223, thereby the upstream annular sealing portion 255 is brought into tight contact with the structural member 223 without being firmly secured by, for example, an adhesive. Thus, the openings of the introduction holes 43 of the ink introduction needles 42 and openings of the nozzles N communicate with one another in an airtight manner through the channels for the ink in the liquid discharge head 20 (channels of, for example, the first channel unit G1, the second channel unit G2, the upper case member 22, the lower case member 23, and the liquid discharge units 70). The openings of the introduction holes 43 of the ink introduction needles 42 and the openings of the nozzles N are included in openings that allow the channels in the liquid discharge head 20 to communicate with the outside.

When any of the channel structures (for example, the first channel unit G1, the second channel unit G2, the upper case member 22, the lower case member 23, the liquid discharge units 70, and so forth) or the liquid discharge head 20 including the channel members is transported as a single component, openings communicating with the outside may be closed by protective films to suppress entry of foreign matter into the channels during transportation. Meanwhile, the component may be transported under an environment where the atmospheric pressure or temperature largely varies such as an environment during an airlift. In such a case, depending on the material of the protective films or the method of closing the openings communicating with the outside, simply closing the openings by the protective films may result in, due to variation in atmospheric pressure or temperature in the channels, deformation of the channels or, even when the channels are not deformed, fatigue of the channel members themselves. Such fatigue of the channel members may lead to degradation of strength.

Figure 6:
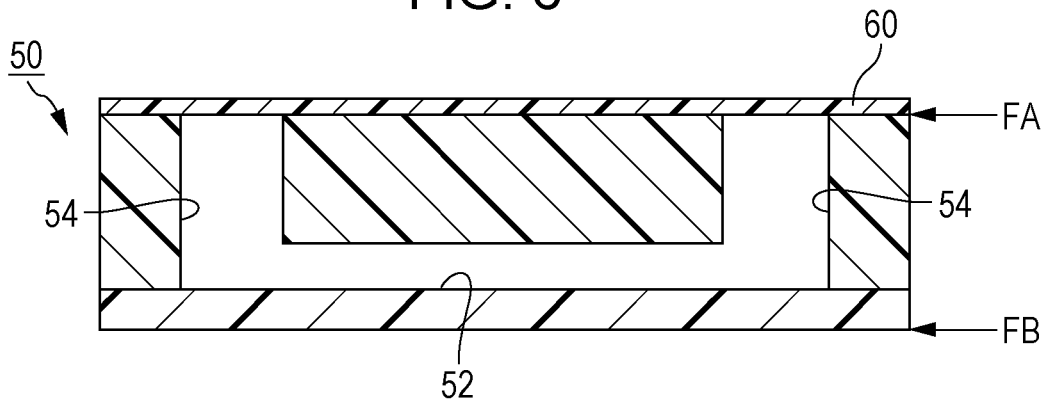
FIG. 6 is a sectional view of a state of a channel structure before transportation.

Here, changes in the state of the channel structures occurring due to variation in atmospheric pressure during transportation are described. For ease of understanding of the description, an example is described in which a channel structure 50 having a simple structure is transported as a single unit. FIG. 6 is a sectional view of a state of the channel structure 50 before transportation. The channel structure 50 illustrated in FIG. 6 is formed by coupling two channel members formed of, for example, polydimethylsiloxane (PDMS) to each other. A channel 52 is formed in the channel members. The channel 52 has two openings 54 communicating with the outside of the channel structure 50. The channel structure 50 has two surfaces FA, FB parallel to each other. The two openings 54 penetrate through one surface FA of the channel structure 50 so as to allow communication between the channel 52 and the outside. As illustrated in FIG. 6, when the channel structure 50 is transported, a protective film 60 is bonded to the one surface FA so as to close the two openings 54 by the protective film 60. This suppresses entry of foreign matter such as dust or dirt into the channel 52 through the openings 54.

Figure 7A:
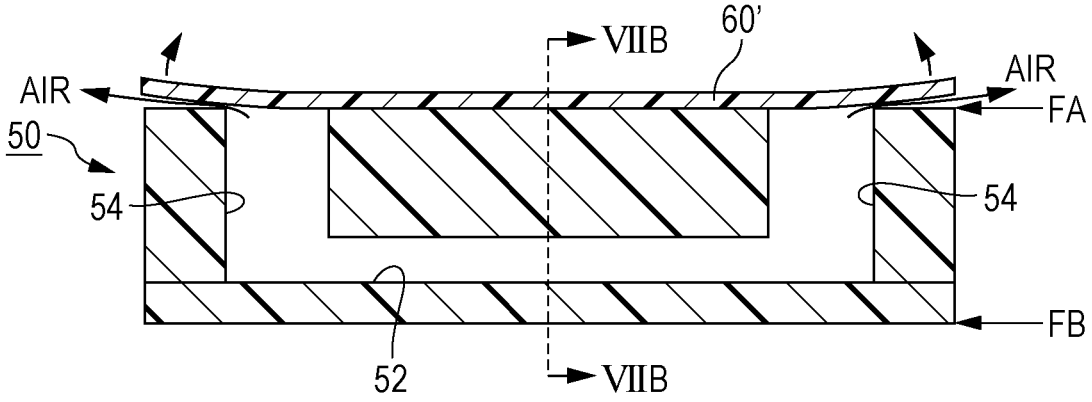
FIG. 7A is a sectional view when transportation is performed with openings closed by a non-air-permeable protective film.
Figure 7B:
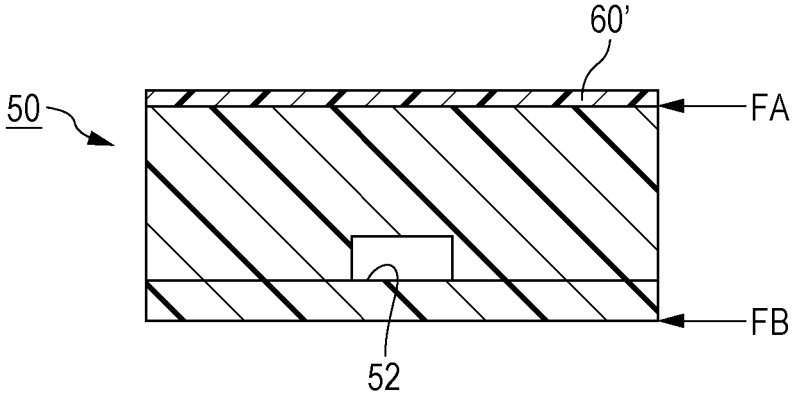
FIG. 7B is a sectional view of the channel structure illustrated in FIG. 7A taken along line VIIB-VIIB.
Figure 8A:
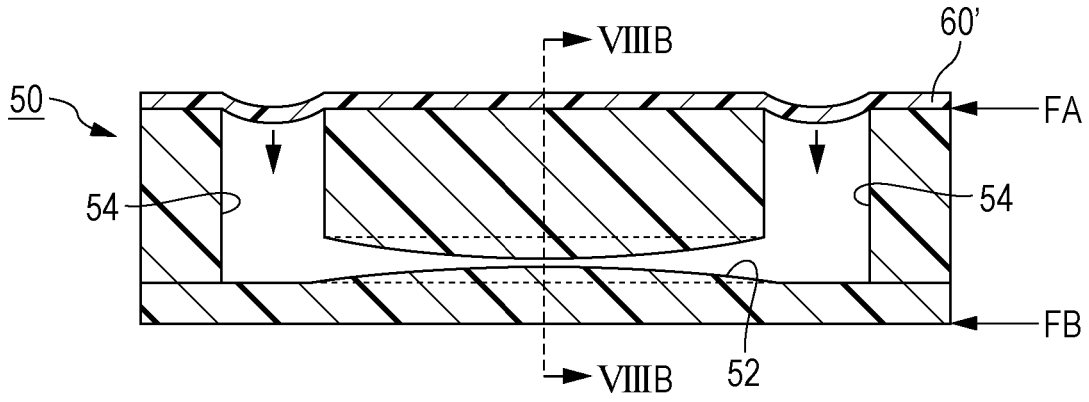
FIG. 8A is a sectional view when transportation is performed with the openings closed by a non-air-permeable protective film.
Figure 8B:
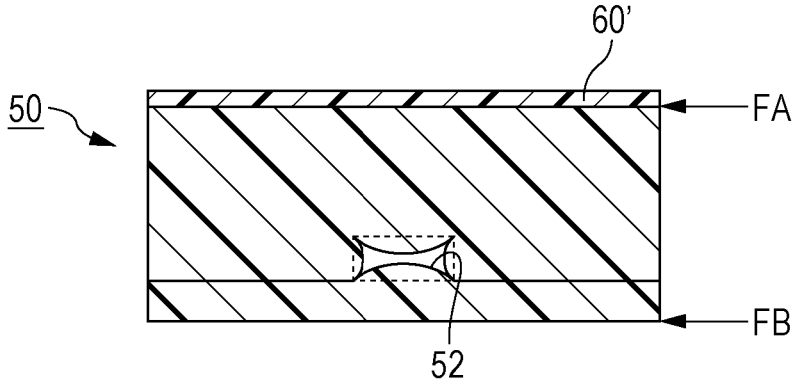
FIG. 8B is a sectional view of the channel structure illustrated in FIG. 8A taken along line VIIIB-VIIIB.

FIGS. 7A, 7B, 8A, and 8B are sectional views illustrating changes in the state of the channel structure 50 when a protective film 60' having no air permeability is used. FIGS. 9A, 9B, 10A, and 10B are sectional views illustrating changes in the state of the channel structure 50 when the protective film 60 having air permeability is used. In FIGS. 7A, 7B, 9A, and 9B, the atmospheric pressure has reduced during transportation. In FIGS. 8A, 8B, 10A, and 10B, the atmospheric pressure that had reduced during transportation has increased to the original value. FIG. 7B is a sectional view of the channel structure 50 illustrated in FIG. 7A taken along line VIIB-VIIB. FIG. 8B is a sectional view of the channel structure 50 illustrated in FIG. 8A taken along line VIIIB-VIIIB. FIG. 9B is a sectional view of the channel structure 50 illustrated in FIG. 9A taken along line IXB-IXB. FIG. 10B is a sectional view of the channel structure 50 illustrated in FIG. 10A taken along line XB-XB.

When the channel structure 50 is transported with the openings 54 closed by the non-air-permeable protective film 60' as illustrated in FIGS. 7A and 7B, reduction in atmospheric pressure during the transportation causes air in the channel 52 and the openings 54 to expand. At this time, with the non-air-permeable protective film 60', the air in the channel 52 cannot pass through the protective film 60'. Thus, the protective film 60' is pushed upward by the air in the channel 52 and the openings 54, thereby being separated from the one surface FA of the channel structure 50. The air in the channel 52 flows out from a gap formed between the protective film 60' and the one surface FA. After that, as illustrated in FIGS. 8A and 8B, when the atmospheric pressure having reduced during the transportation increases to the original value, the air in the channel 52 and the openings 54 contracts. At this time, with the non-air-permeable protective film 60', the air cannot pass through the protective film 60' so as to flow into the channel 52. Accordingly, as illustrated in FIGS. 8A and 8B, the protective film 60' is pulled into the openings 54 and brought into close contact with the one surface FA. Thus, the air is not pulled into the channel 52 or the openings 54. For this reason, the pressure in the channel 52 and the openings 54 become a negative pressure. Thus, there is a possibility of the channel 52 to be deformed so as to be flattened. Furthermore, even when the channel 52 is not deformed, the channel members included in the channel structure 50 are subjected to the pressure for a long time. Thus, there is a possibility of the channel members themselves becoming fatigued, and accordingly, being reduced in strength.

Figure 9A:
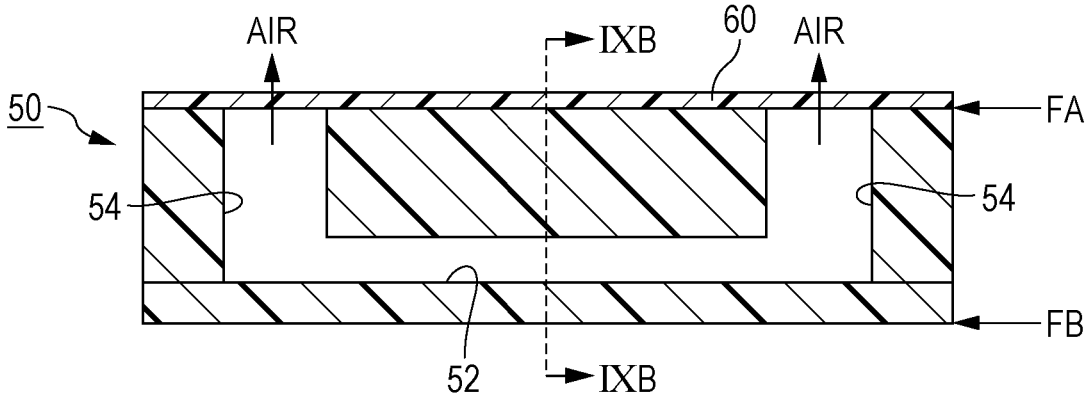
FIG. 9A is a sectional view when transportation is performed with the openings closed by an air-permeable protective film.
Figure 9B:
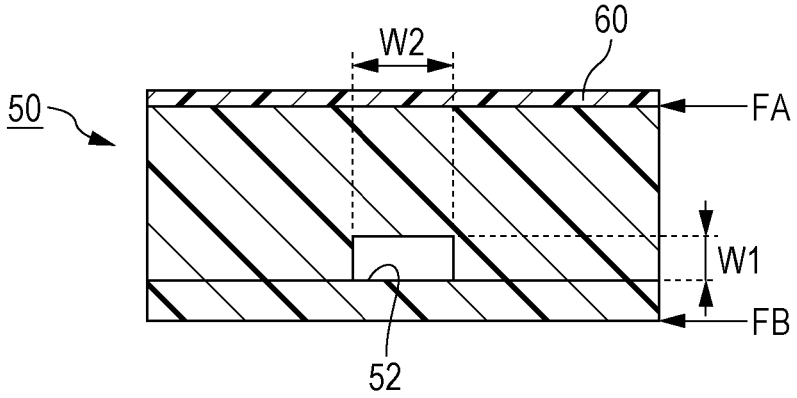
FIG. 9B is a sectional view of the channel structure illustrated in FIG. 9A taken along line IXB-IXB.
Figure 10A:
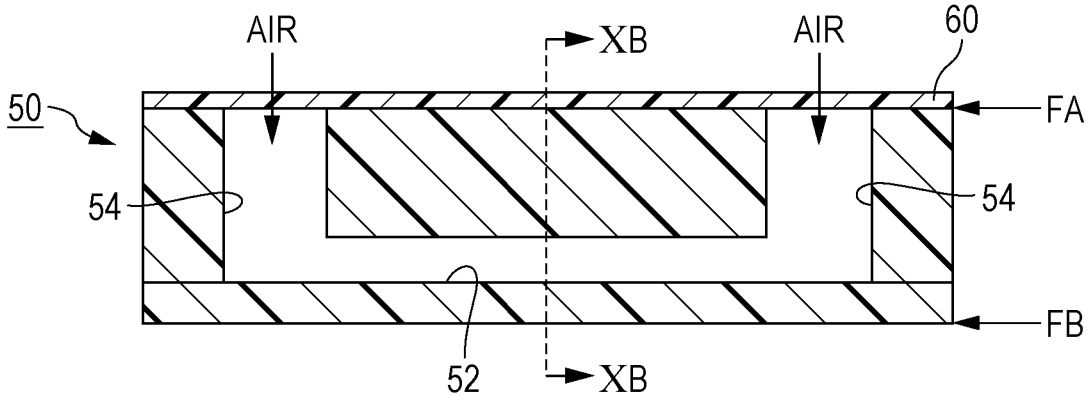
FIG. 10A is a sectional view when transportation is performed with the openings closed by an air-permeable protective film.
Figure 10B:
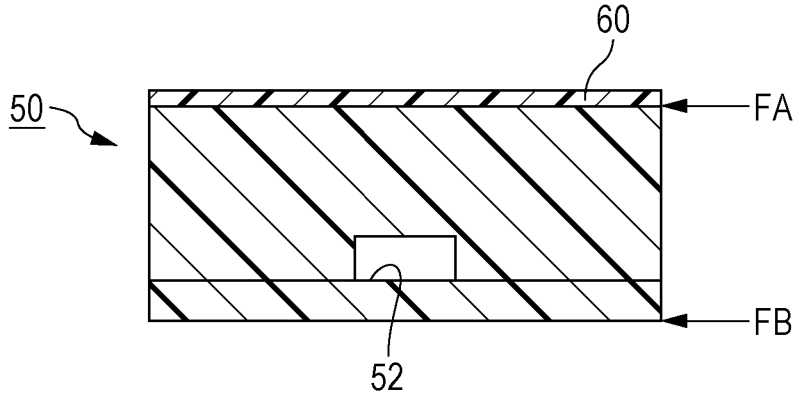
FIG. 10B is a sectional view of the channel structure illustrated in FIG. 10A taken along line XB-XB.

Also when the channel structure 50 is transported with the openings 54 closed by the air-permeable protective film 60 as illustrated in FIGS. 9A and 9B, reduction in atmospheric pressure during the transportation causes air in the channel 52 and the openings 54 to expand. However, when the protective film 60 has air permeability, the air in the channel 52 can pass through the protective film 60. Thus, the air in the channel 52 can flow out through the protective film 60 without separation of the protective film 60 from the one surface FA of the channel structure 50. After that, as illustrated in FIGS. 10A and 10B, when the atmospheric pressure having reduced during the transportation increases to the original value, the air in the channel 52 and the openings 54 contracts. Even in that case, since the protective film 60 has air permeability, the air flows into the channel 52 through the protective film 60. Thus, as illustrated in FIGS. 10A and 10B, the protective film 60 is not pulled into the openings 54 or a situation in which insides of the channel 52 and the openings 54 are subjected to pressure for a long time does not occur. This can suppress deformation of the channel 52 or reduction in strength due to fatigue of the channel members. As a result, since the reduction in strength of the channel structure 50 can be suppressed, reduction in life of the channel structure 50 can be suppressed.

It is preferable that the diameter of air holes of the air-permeable protective film 60 be 1/100 to 1/10 of a minimum width of the section of the channel 52. In some channel members included in the liquid discharge head 20 or the channel structure 50, channels having a size of several to several tens of μm are formed. For example, a width W2 and a width W1 of the channel 52 illustrated in FIG. 9B is respectively 2 μm and 1 to 4 μm. The section of the channel 52 illustrated in FIG. 9B is rectangular, and the width W1 perpendicular to the surface FA of the channel structure 50 is smaller than the width W2 parallel to the surface FA of the channel structure 50. Thus, the minimum width of the channel 52 is the width W1. However, in the case where the channel 52 is such a channel having the width W1 and the width W2 smaller than the width W1, the minimum width of the channel 52 is the width W2. The sectional shape of the channel 52 is not limited to a rectangle and may be a circular shape such as a perfect circle or an ellipse. When the sectional shape of the channel is circular, a minimum diameter of the section is the minimum width of the channel 52. With such a protective film 60, foreign matter is unlikely to pass through the protective film 60 and the air easily passes through the protective film 60. Furthermore, the channel 52 of a very small size is easily deformed particularly due to the expansion or contraction of the air caused by variation in atmospheric pressure or temperature during transportation. Accordingly, when transportation is performed with the openings 54 closed by the air-permeable protective film 60 as in the present embodiment, the effect that can suppress deformation of the channel 52 is significant.

Furthermore, it is preferable that an average diameter of the air holes of the air-permeable protective film 60 be 10 nm to 100 μm. With such an average diameter, the protective film 60 allows the air in the channel 52 to pass therethrough and entry of small foreign matter into the channel can be suppressed. Furthermore, it is preferable that the air-permeable protective film 60 have a Gurley value of 0.5 to 2000 s/100 mL. The Gurley value, which is defined in the Japanese Industrial Standards (JIS) P8117, is a time period required to pass the air of 100 mL from one side to the other side of a film having an area of 1 $inch^2$ with a differential pressure of 1.22 KPa. For example, when the Gurley value is t, the ISO air permeability value P is 135.3/t (μm/(s·Ps)). Such a protective film 60 allows the air to easily pass therethrough even when the air in the channel 52 or the openings 54 expands or contracts due to variation in atmospheric pressure. Accordingly, a situation in which the insides of the channel 52 and the openings 54 are subjected to pressure for a long time does not occur. This can effectively suppress deformation of the channel 52 or reduction in strength due to fatigue of the channel members.

Furthermore, when the entirety of the protective film 60 that closes the openings 54, which allow the channel 52 to communicate with the outside, is air permeable as illustrated in FIGS. 9A to 10B, the air in the channel 52 or the openings 54 easily passes through the protective film 60. This can reduce stress applied to the channel members due to the expansion or contraction of the air in the channel 52 or the openings 54. Alternatively, the openings 54 may be closed such that one of the openings 54 is closed by the air-permeable protective film 60 and the other opening 54 is closed by the non-air-permeable protective film 60'. Also in this way, the air in the channel 52 or the openings 54 can pass through the air-permeable protective film 60, and accordingly, deformation of the channel 52 and reduction in strength of the channel members can be suppressed.

Furthermore, the material of the channel members included in the channel structure 50 is not limited to PDMS and may be silicon (Si), polyphenylenesulfide (PPS) resin, or the like. Furthermore, the channel structure 50 may be a composite member formed by coupling a plurality of members formed of different materials.

As has been described, according to the present embodiment, when the liquid discharge head 20 or the channel structure is transported as a single component with the plurality of openings that allow the channels to communicate with the outside closed by the protective film 60, the protective film 60 that closes at least one of the plurality of openings has air permeability. Thus, during transportation, entry of foreign matter into the channels can be suppressed and deformation of the channels or fatigue of the channel members due to variation in atmospheric pressure or temperature can be suppressed.

Figure 11:
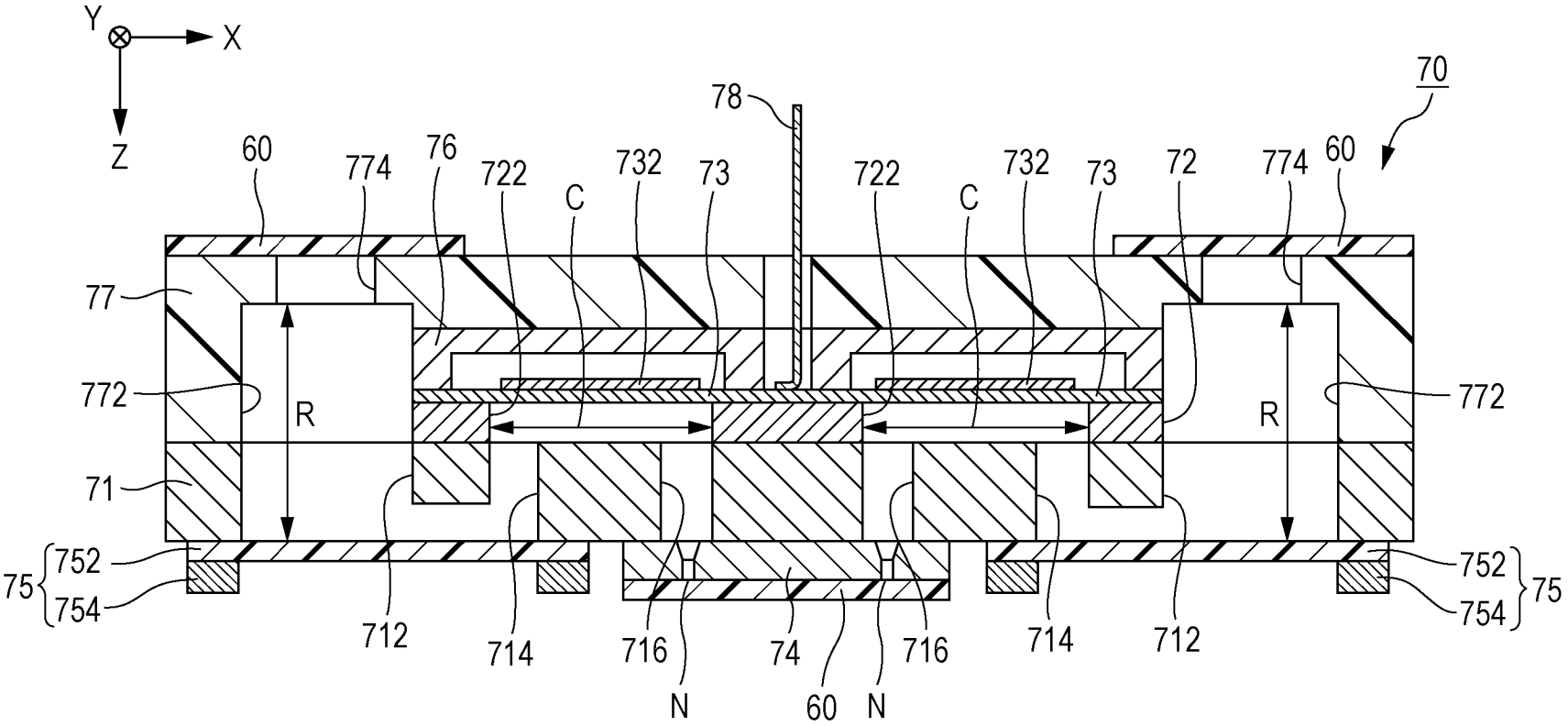
FIG. 11 is a sectional view of the liquid discharge unit when the liquid discharge unit is transported as a single unit.

Hereafter, the case where the liquid discharge unit 70 as the channel structure is transported as a single unit and the case where the liquid discharge head 20 is transported as a single unit are specifically described with examples. FIG. 11 illustrates an example of the case where the liquid discharge unit 70 is transported as a single unit. As illustrated in FIG. 11, in the liquid discharge unit 70, the liquid storage chambers R, the openings 712, the supply channels 714, the communication channels 716, the pressure chambers C, and so forth correspond to "channels formed in the channel members", and openings of the supply ports 774 and the openings of the nozzles N correspond to "openings allowing the channels to communicate with the outside". Accordingly, when the liquid discharge unit 70 is transported as a single unit, the openings of the supply ports 774 and the openings of the nozzles N are closed by protective films 60.

In the example illustrated in FIG. 11, all the protective films 60 closing the openings of the supply ports 774 and the openings of the nozzles N have air permeability. Thus, during transportation of the liquid discharge unit 70, entry of foreign matter into the channels can be suppressed and deformation of the channels or fatigue of the channel members due to variation in atmospheric pressure or temperature can be suppressed. The openings of the supply ports 774 and the nozzles N may be closed such that, for each of the channels of the ink, at least one of the opening of the supply port 774 and the opening of the nozzle N is closed by the air-permeable protective film 60 and the other opening is closed by the non-air-permeable protective film.

Figure 12:
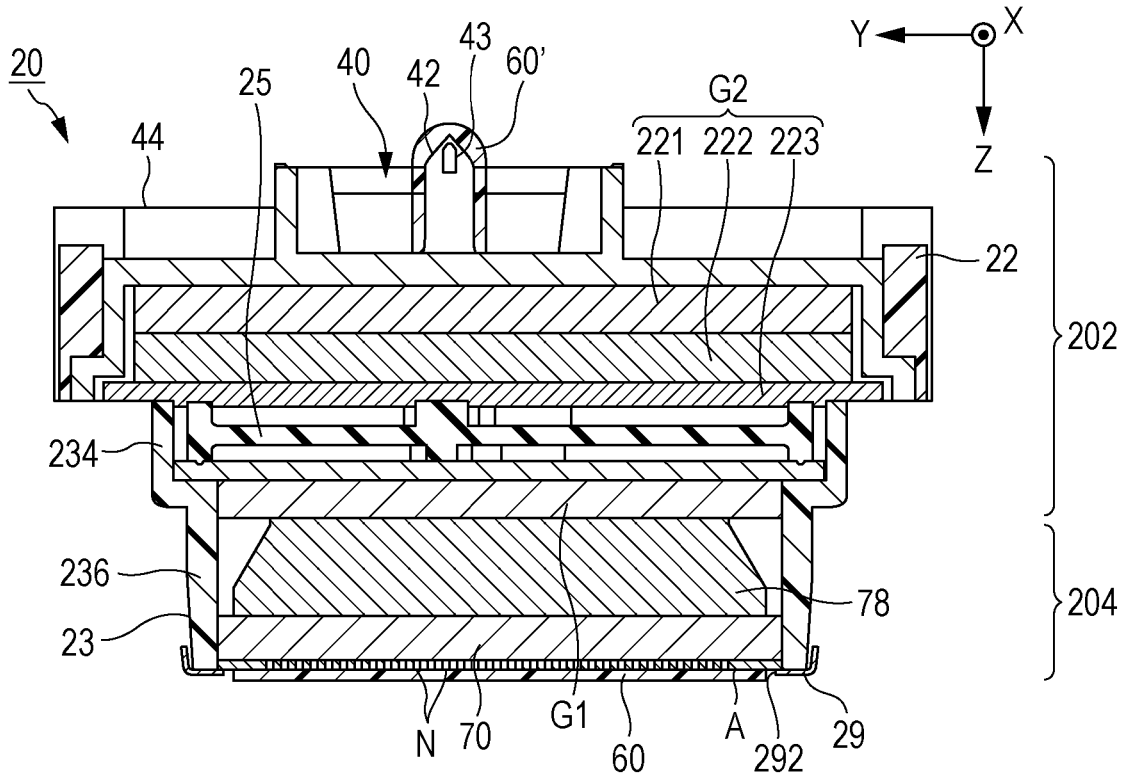
FIG. 12 is a sectional view of the liquid discharge head when the liquid discharge head is transported as a single unit.

FIG. 12 illustrates an example of the case where the liquid discharge head 20 is transported as a single unit. As illustrated in FIG. 12, in the liquid discharge head 20, the channels in the liquid discharge head 20 correspond to "channels formed in the channel members", and the openings of the introduction holes 43 of the ink introduction needles 42 and the openings of the nozzles N correspond to "openings allowing the channels to communicate with the outside". Accordingly, when the liquid discharge head 20 is transported as a single unit, the openings of the introduction holes 43 of the ink introduction needles 42 and the openings of the nozzles N are closed by the protective films 60.

In the example illustrated in FIG. 12, the openings of the introduction holes 43 of the ink introduction needles 42 are closed by cap-shaped non-air-permeable protective films 60', and the openings of the nozzles N are closed by the air-permeable protective films 60. Thus, during transportation of the liquid discharge head 20, entry of foreign matter into the channels can be suppressed and deformation of the channels or fatigue of the channel members due to variation in atmospheric pressure or temperature can be suppressed. When there are a plurality of the openings of the introduction holes 43 of the ink introduction needles 42 and a plurality of the openings of the nozzles N, the openings may be closed such that, in each of the channels that allow communication between the openings of the introduction holes 43 of the ink introduction needles 42 and the openings of the nozzles N, at least one of the openings is closed by the air-permeable protective film 60 and the other opening is closed by the non-air-permeable protective film.

Variations

The exemplified forms and the embodiment having been described can be varied in a variety of manners. Specific forms of variations are exemplified as follows. Two or more of the forms arbitrarily selected from among the following examples and the above-described forms can be appropriately combined as long as no conflict occurs between the selected two or more forms.

Figure 13:
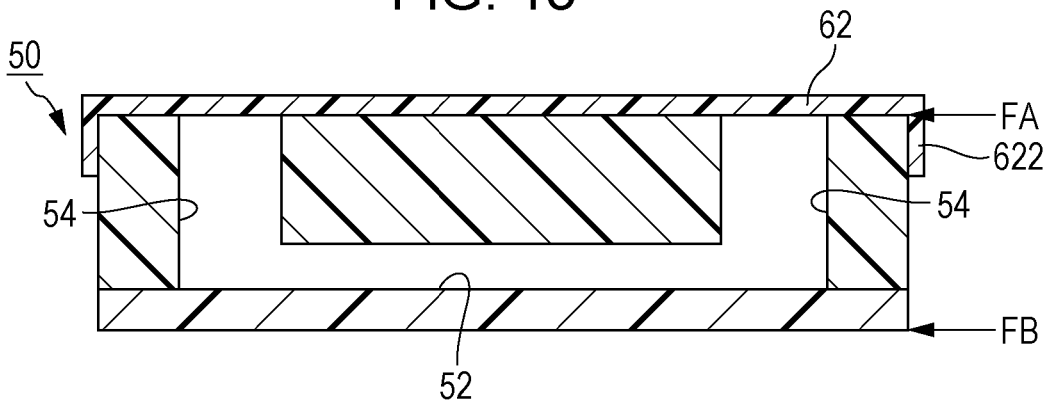
FIG. 13 is a sectional view of a state of the channel structure with the openings of the channel structure closed by a protective member according to a variation.

1. Although the protective films 60 are bonded to the channel structure 50 according to the above-described embodiment, members that close the openings 54 of the channel structure 50 (lid members) are not limited to the protective film 60. For example, as exemplified in FIG. 13, the plurality of openings 54 may be closed by a protective member 62 provided on the surface FA of the channel structure 50. The protective member 62 is a flat plate-shaped cap. For example, the protective member 62 is formed of a resin material by injection molding. The openings 54 are closed by contact of the protective member 62 with the surface FA of the channel structure 50. Specifically, side wall portions 622 are formed along circumferential edges of the protective member 62, and inner circumferential surfaces of the side wall portions 622 are brought into tight contact with side surfaces of the channel structure 50. Thus, the protective member 62 is secured to the channel structure 50. Similarly to the above-described protective films 60, the protective member 62 has air permeability. The conditions regarding the air permeability of the protective member 62 are similar to those of the protective films 60 having been described.

Figure 14:
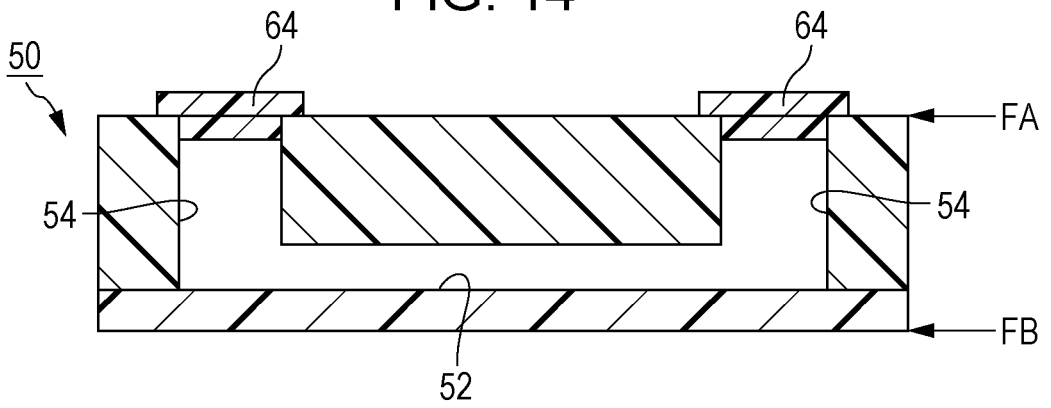
FIG. 14 is a sectional view of a state of the channel structure with the openings of the channel structure closed by protective members according to a variation.

Alternatively, the openings 54 of the channel structure 50 may be closed by protective members 64 exemplified in FIG. 14. The protective members 64 exemplified in FIG. 14 are caps parts of which are inserted into the respective openings 54 so as to close the openings 54. For example, the protective members 64 are formed of a resin material by injection molding. Although the separate protective members 64 are each provided for a corresponding one of the openings 54 in FIG. 14, the protective members 64 continuous with one another may be provided for the plurality of openings 54. Similarly to the above-described protective films 60, the protective members 64 illustrated in FIG. 14 have air permeability. The conditions regarding the air permeability of the protective members 64 are similar to those of the protective films 60 having been described.

As can be understood from the above-described examples, according to preferred forms of the invention, the plurality of openings 54 of the channel structure 50 are closed by the lid member or lid members having the air permeability. Each of the protective films 60 illustrated in FIG. 6, the protective member 62 illustrated in FIG. 13, and each of the protective members 64 illustrated in FIG. 14 are specific examples of a lid member.

2. Although a serial scan head in which the carriage 18 on which the liquid discharge head 20 is mounted repeatedly reciprocates in the X direction has been described as the example according to the above-described embodiment, the invention can be applied also to a line scan head in which liquid discharge heads 20 are arranged throughout the width of the medium 11.

3. Although the liquid discharge head 20 of a piezoelectric method that utilizes piezoelectric elements applying mechanical vibration to pressure chambers is described as the example according to the above-described embodiment, a liquid discharge head of a thermal method that utilizes heating elements generating bubbles in pressure chambers by heating may be used.

4. The liquid discharge apparatus 10 described as the example according to the above-described embodiment can be used for any of a variety of apparatuses such as facsimile machines and copiers other than apparatuses dedicated to printing. Furthermore, application of the liquid discharge apparatus 10 according to the invention is not limited to printing. For example, a liquid discharge apparatus that discharges a solution of colorant is used as any of manufacturing apparatuses that form color filters of liquid crystal displays, organic electroluminescent (EL) displays, field-emission displays (FEDs) and so forth. Furthermore, a liquid discharge apparatus that discharges a solution of a conductive material are used as any of manufacturing apparatuses that form wiring and electrodes of wiring substrates. Furthermore, a liquid discharge apparatus is used as any of chip manufacturing apparatuses that discharge solutions of biological organic matter as a type of liquid.

The entire disclosure of Japanese Patent Application No. 2017-220605, filed Nov. 16, 2017 and the entire disclosure of Japanese Patent Application No. 2018-079564, filed Apr. 18, 2018 are expressly incorporated by reference herein.

What is claimed is:

1. A channel structure comprising:

a channel that is formed in a channel member; and a plurality of openings that allow the channel to communicate with an outside, wherein the plurality of openings are closed by respective lid members, and wherein at least one of the lid members that closes at least one of the plurality of openings has air permeability.

2. The channel structure according to claim 1, wherein all of the plurality of openings are closed by lid members having the air permeability.

3. The channel structure according to claim 1, wherein a diameter of at least one air hole of the at least one of the lid members having the air permeability is $1/100$ to $1/10$ of a minimum width of a section of the channel.

4. The channel structure according to claim 1, wherein the at least one lid member includes a plurality of air holes, and wherein an average diameter of the plurality of air holes of the at least one of the lid members having the air permeability is 10 nm to 100 μm.

5. The channel structure according to claim 1, wherein the at least one of the lid members having the air permeability has a Gurley value of 0.5 to 2000 s/100 mL.

6. The channel structure according to claim 1, further comprising:

a nozzle that communicates with the channel, and wherein the plurality of openings include an opening of the nozzle.

7. A liquid discharge head having a nozzle that discharges a liquid, the liquid discharge head comprising:

a channel that is formed in a channel member; and a plurality of openings that allow the channel to communicate with an outside, wherein the plurality of openings include an opening of the nozzle and an opening that is other than the opening of the nozzle, wherein the plurality of openings are closed by respective lid members, and wherein at least one of the lid members that closes at least one of the plurality of openings has air permeability.

* * * * *